US007217389B2

(12) United States Patent
Amick

(10) Patent No.: US 7,217,389 B2
(45) **Date of Patent: *May 15, 2007**

(54) TUNGSTEN-CONTAINING ARTICLES AND METHODS FOR FORMING THE SAME

(76) Inventor: Darryl D. Amick, 3227 Countryman Cir. NW., Albany, OR (US) 97321

( * ) Notice: Subject to any disclaimer, the term of this patent is extended or adjusted under 35 U.S.C. 154(b) by 588 days.

This patent is subject to a terminal disclaimer.

(21) Appl. No.: 10/041,873

(22) Filed: Jan. 7, 2002

(65) Prior Publication Data

US 2002/0124759 A1 Sep. 12, 2002

Related U.S. Application Data

(60) Provisional application No. 60/296,267, filed on Jun. 5, 2001, provisional application No. 60/260,626, filed on Jan. 9, 2001.

(51) Int. Cl.
*F42B 5/16* (2006.01)

(52) U.S. Cl. ..... 419/38; 102/517

(58) Field of Classification Search ..... 419/38; 102/517

See application file for complete search history.

(56) References Cited

U.S. PATENT DOCUMENTS

| | | | | |
|---|---|---|---|---|
| 1,847,617 | A | 3/1932 | Löwenstein et al. | |
| 2,119,876 | A | 6/1938 | Corson | |
| 2,183,359 | A | 12/1939 | Smithells | |
| 2,919,471 | A | 1/1960 | Hechinger | |
| 2,995,090 | A * | 8/1961 | Daubenspeck | 102/529 |
| 3,123,003 | A | 3/1964 | Lange, Jr. et al. | |
| 3,372,021 | A | 3/1968 | Forbes et al. | |
| 3,623,849 | A | 11/1971 | Benjamin | |
| 3,785,801 | A | 1/1974 | Benjamin | |
| 3,888,636 | A | 6/1975 | Sczerzenie et al. | |
| 3,890,145 | A | 6/1975 | Hivert et al. | |
| 3,953,194 | A | 4/1976 | Hartline, III et al. | |
| 3,979,234 | A | 9/1976 | Northcutt, Jr. et al. | |
| 4,027,594 | A | 6/1977 | Olin et al. | |
| 4,035,115 | A | 7/1977 | Hansen | |
| 4,035,116 | A | 7/1977 | O'Brien et al. | |
| 4,138,249 | A | 2/1979 | Rosof | |
| 4,274,940 | A | 6/1981 | Plancqueel et al. | |

(Continued)

FOREIGN PATENT DOCUMENTS

| | | |
|---|---|---|
| CA | 521944 | 2/1956 |

(Continued)

OTHER PUBLICATIONS

Condensed Chemical Dictionary (CDC), 10th ed., p. 153, defintion of bronze, 1981.*

(Continued)

*Primary Examiner*—George P. Wyszomierski
(74) *Attorney, Agent, or Firm*—Kolisch Hartwell, P.C.

(57) ABSTRACT

Articles formed from powders containing tungsten and at least one binder. In some embodiments, the article contains at least one metallic binder. In some embodiments, the article contains at least one non-metallic binder, such as a polymeric binder. In some embodiments, the article contains both a metallic binder and a non-metallic binder. In some embodiments the article is a firearms projectile, such as a bullet or shot, which may be ferromagnetic or non-ferromagnetic, which may be frangible or infrangible, and which may be jacketed or unjacketed. In some embodiments, the article is a radiation shield, and in other embodiments, the article is a weight or foundry article. In some embodiments, the article has a density in the range of approximately 8 g/cc and approximately 15 g/cc.

60 Claims, 5 Drawing Sheets

U.S. PATENT DOCUMENTS 4,338,126 A 7/1982 Vanderpool et al.
4,383,853 A 5/1983 Zapffe
4,428,295 A 1/1984 Urs
4,488,959 A 12/1984 Agar
4,508,567 A * 4/1985 Mizuno et al. ..... 75/231
4,760,794 A 8/1988 Allen
4,762,559 A 8/1988 Penrice et al.
4,780,981 A 11/1988 Hayward et al.
4,784,690 A 11/1988 Mullendore
4,881,465 A 11/1989 Hooper et al.
4,897,117 A 1/1990 Penrice
4,931,252 A 6/1990 Brunisholz et al.
4,940,404 A 7/1990 Ammon et al.
4,949,644 A 8/1990 Brown
4,949,645 A 8/1990 Hayward et al.
4,960,563 A 10/1990 Nicolas
4,961,383 A 10/1990 Fishman et al.
4,990,195 A 2/1991 Spencer et al.
5,069,869 A 12/1991 Nicolas et al.
5,088,415 A 2/1992 Huffman et al.
5,264,022 A 11/1993 Haygarth et al.
5,279,787 A 1/1994 Oltrogge
5,399,187 A * 3/1995 Mravic et al. ..... 75/228
5,527,376 A 6/1996 Amick et al.
5,616,642 A 4/1997 West et al.
5,713,981 A * 2/1998 Amick ..... 75/340
5,719,352 A 2/1998 Griffin
5,740,516 A 4/1998 Jiranek, II et al.
5,760,331 A * 6/1998 Lowden et al. ..... 102/506
5,786,416 A 7/1998 Gardner et al.
5,814,759 A 9/1998 Mravic et al.
5,820,707 A 10/1998 Amick et al.
5,831,188 A 11/1998 Amick et al.
5,847,313 A 12/1998 Beal
5,868,879 A 2/1999 Amick et al.
5,877,437 A 3/1999 Oltrogge
5,905,936 A 5/1999 Fenwick et al.
5,913,256 A 6/1999 Lowden et al.
5,917,143 A 6/1999 Stone
5,922,978 A 7/1999 Carroll
5,950,064 A * 9/1999 Robinson et al. ..... 419/47
5,963,776 A 10/1999 Lowden et al.
6,048,379 A * 4/2000 Bray et al. ..... 75/229
6,090,178 A 7/2000 Benini
6,101,949 A 8/2000 Maucourt et al.
6,136,105 A 10/2000 Spencer
6,174,494 B1 1/2001 Lowden et al.
6,279,447 B1 8/2001 Beal
6,371,029 B1 4/2002 Beal
6,457,417 B1 10/2002 Beal
6,546,875 B2 4/2003 Vaughn et al.
6,551,375 B2 4/2003 Siddle et al.
6,551,376 B1 4/2003 Beal
6,581,523 B2 6/2003 Beal
6,591,730 B2 7/2003 Beal
6,823,798 B2 * 11/2004 Amick ..... 102/517
7,059,233 B2 * 6/2006 Amick ..... 86/54
2002/0152915 A1 10/2002 Vaughn et al.
2003/0027005 A1 2/2003 Elliott
2003/0164063 A1 9/2003 Elliott

FOREIGN PATENT DOCUMENTS

FR 2672619 9/1987
GB 731237 6/1955
GB 1514908 6/1978
GB 2149067 6/1985
JP 52-68800 6/1977
JP 59-6305 1/1984
JP 1-142002 6/1989
WO WO 88/09476 * 12/1988
WO WO 00/37878 6/2000

OTHER PUBLICATIONS

English-language abstract of French Patent No. 2,672,619, 1992.
"Steel 3-inch Magnum Loads Our Pick For Waterfowl Hunting," *Gun Tests*, Jan. 1998, pp. 25-27.
Carmichel, Jim, "Heavy Metal Showdown," *Outdoor Life*, Apr. 1997, pp. 73-78.
"Federal's New Tungsten Pellets," *American Hunter*, Jan. 1997, pp. 19, 48-50.

* cited by examiner

Fig. 1
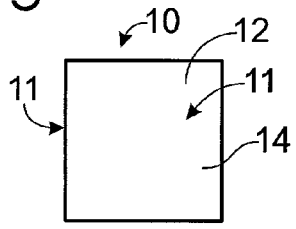
Fig. 2
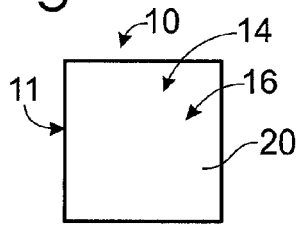
Fig. 3
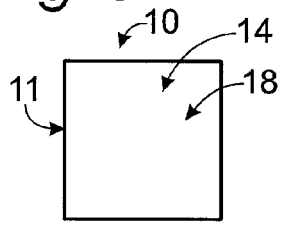
Fig. 4
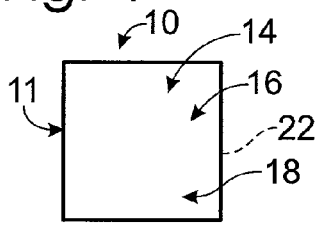
Fig. 5
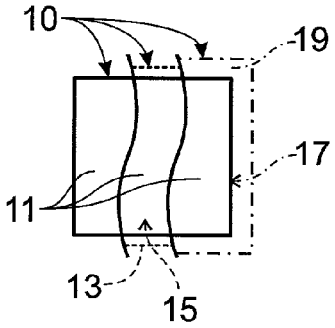
Fig. 7
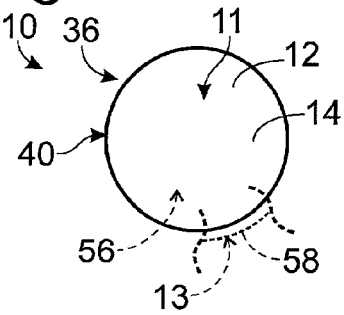
Fig. 8
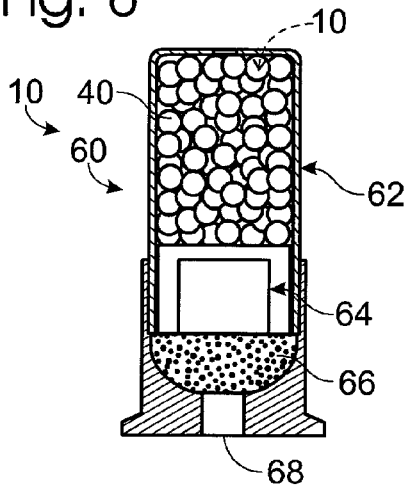
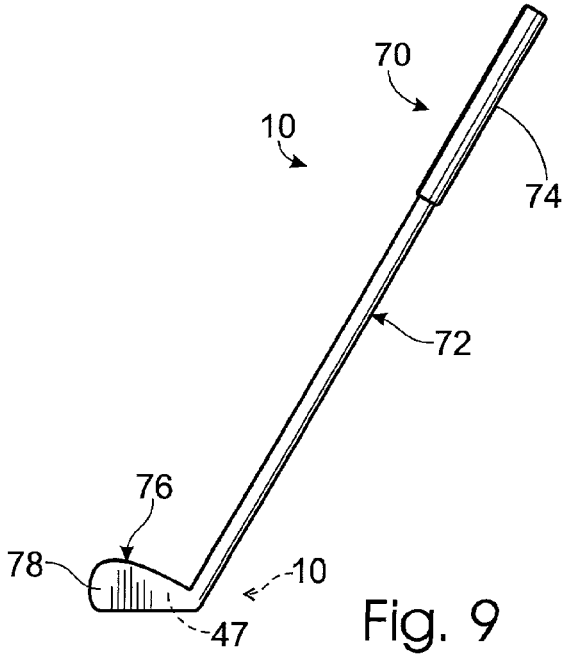
Fig. 9

TUNGSTEN-CONTAINING ARTICLES AND METHODS FOR FORMING THE SAME

RELATED APPLICATIONS

This application claims priority to U.S. Provisional Patent Application Ser. No. 60/260,626, which was filed on Jan. 9, 2001, is entitled "Lead-Substitute Bullet, Cartridge and Method of Preparing the Same," and the complete disclosure of which is hereby incorporated by reference for all purposes. This application also claims priority to U.S. Provisional Patent Application Ser. No. 60/296,267, which was filed on Jun. 5, 2001, is entitled "Tungsten-Tin Projectiles and Articles," and the complete disclosure of which is hereby incorporated by reference for all purposes.

FIELD OF THE INVENTION

The present invention relates generally to the field of powder metallurgy, and more particularly to articles formed from compositions of matter that include a tungsten-containing powder and at least one binder.

BACKGROUND AND SUMMARY OF THE INVENTION

Conventionally, many articles have been produced from lead because of lead's relatively high density (11.3 g/cc) and relatively inexpensive cost. Examples of such articles include firearms projectiles, radiation shields and various weights. More recently, lead substitutes have been sought because of the toxicity of lead. For example, in 1996 the Environmental Protection Agency banned the use of lead shotgun shot for hunting waterfowl. Various lead substitutes have been used, including steel, bismuth and tungsten, with each offering various advantages and disadvantages as compared to lead.

The present invention is directed to articles formed from powders containing tungsten and at least one binder. In some embodiments, the article contains at least one metallic binder. In some embodiments, the article contains at least one non-metallic binder, such as a polymeric binder. In some embodiments, the article contains both a metallic binder and a non-metallic binder. In some embodiments the article is a firearms projectile, such as a bullet or shot, which may be ferromagnetic or non-ferromagnetic, which may be frangible or infrangible, and which may be jacketed or unjacketed. In some embodiments, the article is a radiation shield, and in other embodiments, the article is a weight or foundry article. In some embodiments, the article has a density in the range of approximately 8 g/cc and approximately 15 g/cc.

BRIEF DESCRIPTION OF THE DRAWINGS

FIG. 1 is a schematic representation of an article constructed from a composition of matter according to the present invention.

FIG. 2 is a schematic representation of an article constructed from a composition of matter according to the present invention that contains a metallic binder component.

FIG. 3 is a schematic representation of an article constructed from a composition of matter according to the present invention that contains a non-metallic or polymeric binder component.

FIG. 4 is a schematic representation of an article constructed from a composition of matter according to the present invention that contains a metallic binder component and a polymeric or non-metallic binder component.

FIG. 5 is a schematic representation of finished articles that may be constructed according to the present invention.

FIG. 7 is a side elevation view of a shot constructed according to the present invention.

FIG. 8 is a schematic cross-sectional view of a shotgun shell, or cartridge, containing the shot of FIG. 7.

FIG. 9 is a schematic side elevation view of a golf club constructed with a golf club weight according to the present invention.

DETAILED DESCRIPTION AND BEST MODE OF THE INVENTION

Figure 6:
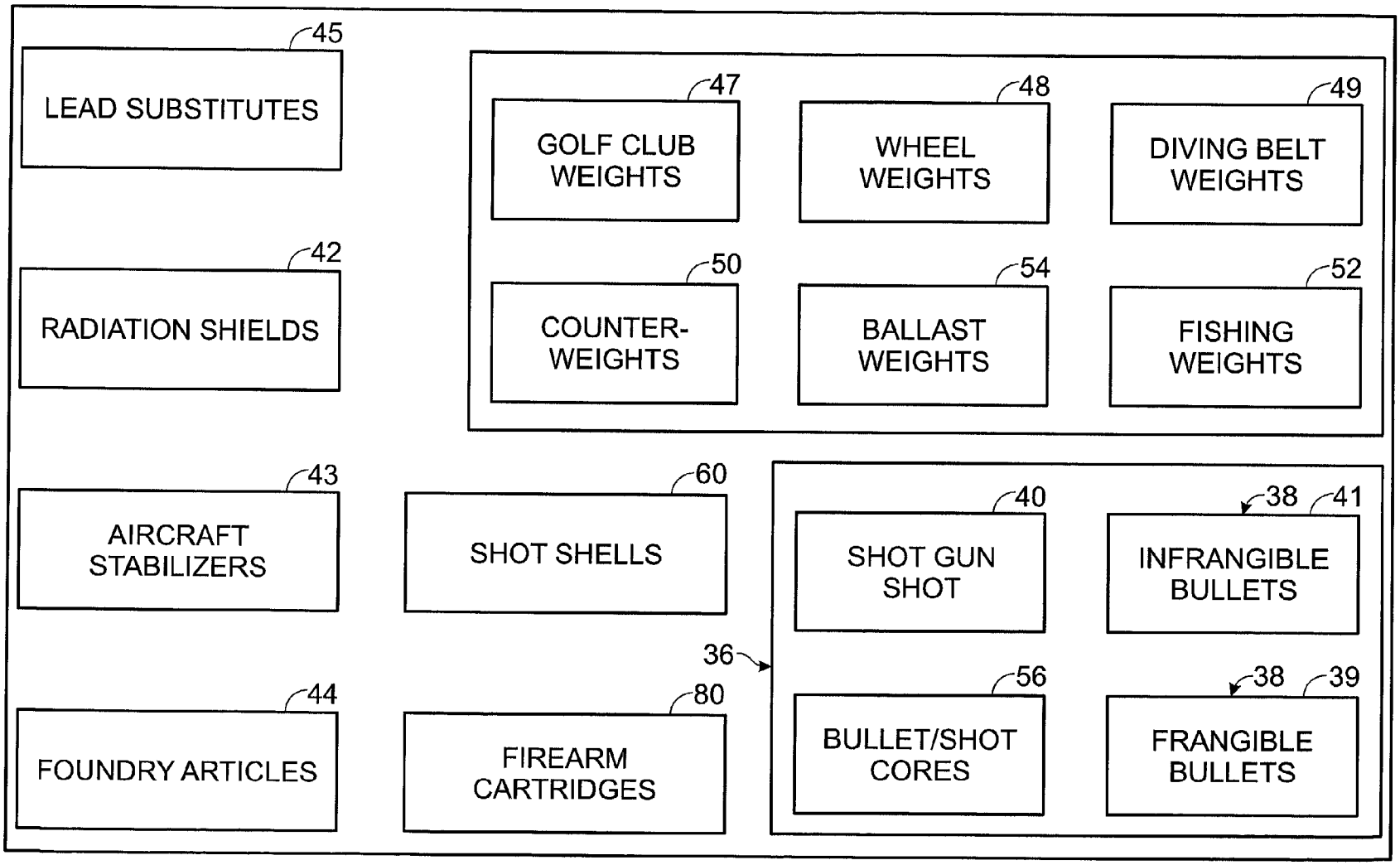
FIG. 6 is a schematic diagram showing illustrative examples of articles constructed according to the present invention.

An article constructed according to the present invention is shown in FIG. 1 and indicated generally at 10. Article 10 is schematically illustrated in FIG. 1 and may have any desired shape and size. Article 10 is at least substantially or completely formed from at least one tungsten-containing powder 14 and at least one binder 12. Binder 12 may be, but is not necessarily, in powder form. It should be understood that as used herein, the term "powder" is meant to include particulate having a variety of shapes and sizes, including generally spherical or irregular shapes, flakes, needle-like particles, chips, fibers, equiaxed particles, etc.

The tungsten-containing powder and the binder are mixed together to form a composition of matter 11 according to the present invention and thereafter compacted during the formation of article 10. Article 10 has a medium- to high-density and may be used for a variety of purposes, such as to form articles that conventionally have been formed from lead. As used herein, medium-density is meant to refer to densities in the range of approximately 8 g/cc to approximately 15 g/cc, and high-density is meant to refer to densities greater than 15 g/cc. It is within the scope of the present invention that article 10 may have a density in the range of 7.7 g/cc and approximately 18 g/cc, and preferably in the range of approximately 8.5 g/cc and approximately 15 g/cc. When an article 10 according to the present invention is intended for use as a lead substitute, the article preferably has a density in the range of approximately 10 g/cc and approximately 13 g/cc, more preferably in the range of approximately 10.5 g/cc and approximately 12 g/cc, and even more preferably a density of approximately 11.1–11.33 g/cc (depending, for example upon whether the article will be a substitute for pure lead, which has a density of 11.3 g/cc, or a lead alloy, such as a lead-antimony alloy having a density of approximately 11.1 or 11.2 g/cc). It should be understood that densities outside of this range are also within the scope of the present invention.

Article 10 may itself form a finished article, meaning that the article is ready for use or sale without additional processing of the article itself. Alternatively, article 10 may be described as forming a component or region of a finished article and/or receive an additional processing step before being a finished article or finished component. For example, article 10 may itself form a firearms projectile according to the present invention. Examples of such projectiles include bullets and shot. These projectiles may also be described as components of other articles, namely, shot shells and firearms cartridges. As a further alternative and example, article 10 may form a core for a bullet or shot, and this core may be jacketed or otherwise coated or encased in a covering material prior to forming one type of finished article, and the jacketed/coated core may thereafter also be incorporated into a shot shell or firearms cartridge to form another type of finished article. As another example, article 10 may form a finished article in the form of a golf club weight according to the present invention, either in its original form or after being coated or otherwise jacketed or encased in a protective coating or shell. Similarly, the golf club weight may be incorporated into another type of finished article, namely a golf club. As another example, a fishing weight may be entirely formed from composition of matter 11 or may have a coated or jacketed core that is formed from the composition of matter. Furthermore, the weight/core may include mounts to secure the weight to a fishing line, leader, swivel or the like and/or may be a component that is inserted into or otherwise forms a portion of the finished weight, such as by being inserted into a housing or body. As still another example, an article may have a body that is formed from composition 11 but which also includes ribs or other partitions or supports that extend through the body and which are formed from other materials.

These alternatives are schematically and graphically depicted in FIG. 5, in which an article 10 formed at least substantially from a composition of matter 11 is shown in solid lines. In dashed lines in FIG. 5, article 10 includes a coating 13 that encases a core 15 formed at least substantially from composition of matter 11. Coating 13 is meant to schematically depict such coating materials and structures as a jacket, shell, painted or sprayed covering, etc. Furthermore, in dash-dot lines in FIG. 5, article 10 is graphically and schematically depicted as including a coated or uncoated core 15 that forms a component 17 of article 10, which in this embodiment also includes other structure 19. The aforementioned firearms cartridge, golf club and fishing weight provide illustrative examples of such a construction. Further examples are provided herein and include such items as radiation shields, wheel weights, aircraft stabilizers, substitutes for other items that have conventionally been formed from lead, etc.

As discussed above, the articles depicted graphically in FIGS. 1–5 have been schematically illustrated and may have a wide variety of shapes and sizes, which will tend to vary according to such factors as the particular type of article and the intended application of the article.

Tungsten-containing powder 14 may take a variety of forms, from powders of pure tungsten (density 19.3 g/cc), powders of a tungsten alloy, powders of more than one tungsten alloy, and combinations thereof. Examples of suitable tungsten alloys are collectively referred to as "WHA's" (tungsten heavy alloys) and have densities in the range of approximately 15 g/cc to approximately 18 g/cc, and often have a density of 17 g/cc or approximately 17 g/cc. These powders are especially well-suited for use in firearms projectiles, weights or other lead substitutes because they can be mixed with less dense materials, such as binder 12, to produce a medium-density article, such as in the ranges identified above, including densities at or near (within 0.01–0.5 g/cc) the density of lead (11.3 g/cc).

Examples of suitable tungsten alloys include, but are not limited to, W—Cu—Ni, W—Co—Cr, W—Ni—Fe, W—Ni, WC (tungsten carbide), W—Fe (ferrotungsten) and alloys of tungsten and one or more of nickel, zinc, copper, iron, manganese, silver, tin, bismuth, chromium, cobalt, molybdenum and alloys formed therefrom, such as brass and bronze. Powders formed from medium-density tungsten alloys may also be used as a suitable source of tungsten-containing powder 14. For example, W—Ni—Fe alloys having densities in the range of 10–15 g/cc and more particularly in the range of 11–13 g/cc or approximately 12 g/cc have proven effective, although others may be used. Still further examples of suitable compositions for tungsten-containing powder 14 include powders formed from 73.64% WHA and 26.36% iron; 70% WHA and 30% zinc; 80% WHA and 20% zinc; 80% WHA, 19% zinc and 1% lubricant; 68% WHA and 32% copper; 68% WHA, 31.5% copper and 0.5% lubricant; 70% WHA and 30% tin; and 70% WHA, 29.5% tin and 0.5% lubricant. The individual tungsten-containing powders may vary in coarseness, or mesh-size.

A particularly well-suited tungsten-containing powder 14 is ferrotungsten powder, which typically has a density in the range of 14–15 g/cc. Another suitable tungsten-containing powder is VHA powder, such as 90W7Fe3Ni (by weight) and similar compositions containing at least 80% tungsten, such as 85–95 wt % tungsten with corresponding percentages of iron and/or nickel. Further examples of suitable tungsten-containing powders 14 include tungsten-containing powders that have been high-energy milled with one or more other metallic powders to produce mechanical alloying effects, as disclosed in U.S. Pat. No. 6,248,150, the complete disclosure of which is hereby incorporated by reference.

Still other well-suited tungsten-containing powders 14 are powders produced from recycled tungsten or recycled tungsten alloys, such as waste materials formed when tungsten or tungsten alloys are forged, swaged, drawn, cropped, sawed, sheared, and machined. Operations such as these inherently produce a variety of metallic scrap, such as machine turnings, chips, rod ends, broken pieces, rejected articles, etc., all of which are generated from materials of generally high unit value because of their tungsten content. Illustrative processes for obtaining this powder, and compositions of such powder are disclosed in co-pending U.S. patent application Ser. No. 09/483,073, which is entitled "Methods for Producing Medium-Density Articles from High-Density Tungsten Alloys," was filed on Jan. 14, 2000, and the complete disclosure of which is hereby incorporated by reference.

Composition of matter 11 may be ferromagnetic or non-ferromagnetic, depending upon the particular compositions and weight percentages of the tungsten-containing powder 14 used to form the composition of matter. When the composition is ferromagnetic, it may be recovered using a magnet, which may be beneficial in applications in which the article is propelled away from a user during use and/or fragmented during use, such as in the context of articles in the form of firearms projectiles and fishing weights. A further feature of a ferromagnetic article constructed according to the present invention is that this ferromagnetism may be used to distinguish ferromagnetic lead-substitutes constructed according to the present invention from lead products.

With the addition of binder 12, the discontinuous-phase of tungsten-containing powder 14 may be formed into a continuous-phase matrix without requiring the tungsten-containing powder to be melted. In other words, binder 12 enables the loose tungsten-containing powder to be formed into an at least relatively defined and durable shape without requiring melting and casting of powder 14. Binder 12 may include at least one of a metallic binder 16 and a polymeric binder 18. Metallic binder 16 and polymeric binder 18 also may be referred to as metallic binder component 16 and polymeric binder component 18, respectively. An example of an article 10 that includes a metallic binder component 16 is schematically illustrated in FIG. 2. In FIG. 3, an example of an article 10 that includes a polymeric binder component 18 is shown, and in FIG. 4, an example of an article 10 that includes both a metallic binder component 16 and a polymeric binder component 18 is shown.

Metallic binder 16 typically is added in powder form to tungsten-containing powder 14. The powders are then mixed and compacted during the formation of article 10. An example of a suitable metallic binder is tin-containing powder 20, as indicated graphically in FIG. 2. Tin-containing powder 20 may be pure or at least substantially pure tin powder. Tin has a density of 7.3 g/cc. Powder 20 may also include elements other than tin, such as a powder containing a tin alloy, such as bronze. However, tin should form at least 40 wt %, and preferably at least 50 wt % of powder 20.

The weight percentage of tin-containing powder 20 in article 10 may vary depending upon such factors as the desired density of the uncompacted and the finished article, the density and amount of other components in the article, the desired strength of the article and the desired flow and ductility of the article. It is within the scope of the invention that powder 20 is present in composition 11 in the range of 5 wt % and 60 wt %. In some embodiments, powder 20 will be present in the range of 10 wt % and 50 wt %, in the range of 15 wt % and 40 wt %, and in the range of 20 wt % and 30 wt %. In some embodiments, composition 11 will contain at least 10 wt % of powder 20, in some embodiments composition 11 will contain less than 50 wt % of powder 20, in some embodiments tin-containing powder 20 will form the largest component (by particle weight percentage and/or by elemental weight percentage) in composition 11, and in some embodiments, composition 11 may be described as containing powder 20 as its majority component.

A factor that contributes to the ability of powder 20 to form an effective binder for article 10 is tin's ability to anneal itself. In other words, tin can be cold worked, or reformed, repeatedly and still establish metallic bonding between itself and tungsten-containing powder 14.

The following table provides examples of compositions and resulting densities of articles, such as firearms projectiles, constructed according to the present invention. The examples are presented in table-form and are presented to provide illustrative, non-limiting examples of articles that may be produced according to the present invention. For example, only ferrotungsten and WHA tungsten-containing powders 14 and at least essentially pure tin powder as tin-containing powder 20 are shown in the table, but it is within the scope of the invention that other tungsten-containing powders 14, including pure tungsten and tungsten carbide, and other tin-containing powders 20 may be used. Similarly, it is within the scope of the invention that compositions 11 and/or articles 10 may include additional components as well, such as powders of other metals or metal alloys. For example, iron powder may be added to reduce the density of the article that otherwise would have a density greater than that of iron.

TABLE 1

Densities of Compositions and Articles Produced from Tin- and Tungsten-Containing Powders

| FeW powder | WHA powder | Tin Powder | Lubricant | Density (g/cc) |
|---|---|---|---|---|
| 58 | 20 | 21.8 | 0.2 | 11–11.7 |
| 68 | 10 | 21.8 | 0.2 | 11.2 |
| 78 | 0 | 21.8 | 0.2 | 11–11.7 |
| 78 | 0 | 22 | 0 | 11 |
| 38–78 | 0–40 | 21.8 | 0.2 | 11+ |
| 0 | 68 | 31.5 | 0.5 | |
| 0 | 70 | 29.5 | 0.5 | |
| 0 | 75 | 24.5 | 0.5 | |
| 66 | 0 | 34 | 0 | 10–10.25 |
| 48–43 | 30–35 | 22 | 0 | 11.5–11.7 |
| 38–28 | 40–50 | 22 | 0 | 12 |
| 0 | 78 | 22 | 0 | 12.8–13 |
| 10 | 0 | 90 | 0 | 7.68 |
| 20 | 0 | 80 | 0 | 8.067 |
| 50 | 0 | 50 | 0 | 9.729 |
| 0 | 10 | 90 | 0 | 7.74 |
| 0 | 20 | 90 | 0 | 8.24 |
| 0 | 50 | 50 | 0 | 10.2 |
| 30 | 40 | 30 | 0 | 10.92 |
| 43 | 35 | 21.8 | 0.2 | 11.5–.7 |
| 43 | 35 | 22 | 0 | 11.7–11.9 |

Non-metallic or polymeric binder 18 may include any suitable polymeric material, or combination of polymeric materials. Examples of suitable polymeric binders include thermoplastic resins and thermoset resins, which are actuated, or cross-linked, by heating. Examples of suitable thermoset resins are melamine and powder-coating epoxies, and examples of suitable thermoplastic resins are nylon (including nylon 6), polyethylene, polyethylene glycol and polyvinyl alcohol. Other suitable polymeric binders are water-actuated polymers, such as Portland cement, vinyl cement and urea formaldehyde, which are actuated by immersion or other contact with water. Still another example of a suitable polymeric binder is a pressure-actuated polymer, such as gum arabic. Still further example of polymeric binders that may be used are gelatin powder and stearic acid.

Particularly well-suited polymeric binders are elastomeric, or flexible, epoxies, which are thermoset resins that are suitable for use as corrosion-resistant coatings on rebar. Because rebar is often bent after being coated, its coating must bend with the rebar to provide the intended corrosion resistance. As such, these epoxies are often referred to as "rebar epoxies." Through experimentation, it has been discovered that these epoxies are particularly well-suited for use as a polymeric binder 18 for forming articles according to the present invention. Examples of suitable elastomeric epoxies for use as binder 18 are sold by the 3M Corporation under the tradename 3M 413™ and by the Dupont Corporation under the trade name 2–2709™. It should be understood that other elastomeric or flexible epoxies may be used and are also within the scope of the invention.

Polymeric binder 18 will typically comprise in the range of approximately 0.1 wt % and approximately 10 wt % of composition 11, and preferably is present in the range of approximately 0.2 wt % and approximately 3 wt %. An example of a subset of this range is approximately 0.25 wt % and approximately 0.65 wt %. It should be understood that percentages outside of this range may be used, however, the amount of binder is typically rather small because polymeric (and other non-metallic) binders 18 tend to have much lower densities than tungsten-containing powder 14. Accordingly, the greater the percentage of binder 18 in composition 11, the lower the density of the resulting article compared to an article with a lesser amount of the polymeric binder. This is an important consideration to remember, especially as the desired density of article 10 increases. For example, as the amount of binder is increased, it may be necessary to use a greater amount of tungsten-containing powders having higher densities to achieve a desired density in the article formed thereby. Similarly, tungsten-containing powders tend to be more expensive than binders 18, and therefore, this would increase the materials cost of the resulting article.

Illustrative, non-exclusive examples of proportions of binders that have proven effective include 1–2 wt % melamine, 1.5–5 wt % Portland or vinyl cement, 2–3 wt % urea formaldehyde, and 2–3 wt % gum arabic, with all or at least a substantial portion of the remainder of composition of matter 11 being formed from tungsten-containing powder 14. It should be understood that these exemplary proportions have been provided for purpose of illustration and that other percentages of these binders may be used and are within the scope of the present invention. Non-exclusive examples of suitable compositions for medium-density compositions and/or articles according to the present invention include the following: 100 g of WHA/Fe (73.64% WHA/26.36% Fe), 161 g of WHA, 4–8 g binder; 50 g WHA/Fe (73.64% WHA/256.36% Fe), 80.5 g WHA, 4 g 3M431™ and 0.27 g lubricant; 65.25 g WHA, 65.25FeW (73.64% WHA/256.36% Fe), 4 g 3M431™ and 0.27 g lubricant; 130.5 g FeW, 3.5 g 3M431 and 0.27 g lubricant; and 116.5 g FeW, 14 g Fe, 2.4 g 3M431 ™ and 0.27 g lubricant. Acrawax™ is an example of a suitable lubricant.

It is also within the scope of the invention that binder 18 may include two or more different types of polymeric or other non-metal binders. For example, a combination of a rigid epoxy and a flexible epoxy may be used to produce an article that has increased strength over a comparable article formed with only a rigid epoxy or only a flexible epoxy. When more than one binder 18 is used, it is preferable that the binders are actuated through the same or compatible mechanisms.

Another example of a suitable binder 12 for composition 11 and articles formed therefrom is a combination of at least one metallic binder component 16 and at least one non-metallic or polymeric binder component 18. For example, binder 12 may constitute approximately 2–30 wt % of the article or composition of matter, with tungsten-containing powder constituting at least a substantial portion, if not all, of the rest of the composition of matter or article. In such an embodiment, the metallic binder component will typically constitute a majority of the binder, and may constitute as much as 70 wt %, 80 wt %, 90 wt %, or more of the binder. A benefit of binder 12 including both metallic and non-metallic binders compared to only polymeric binders is that polymeric binders tend to swell or otherwise expand during actuation of the binder. This expansion decreases the density of the resulting composition of matter or article. However, when binder 12 also includes a metallic binder component 16, such as tin-containing powder 20, this swelling is substantially reduced or eliminated.

As an illustrative example, tin or another tin-containing powder and one or more (flexible and/or rigid) thermoset epoxies have proven effective in experiments. In experiments, a composition of matter was prepared from 88.2 wt % tungsten-containing powder 14 (such as tungsten or ferrotungsten), and 21.8 wt % tin-containing powder 20 (such as pure tin). When 0.2 wt % of the tin-containing powder was replaced with epoxy and the resulting composition was actuated, the crushing strength was approximately doubled. When approximately 0.5 wt % of the tin-containing powder was replaced with epoxy, the crushing strength of the composition was approximately quadrupled. Continuing the above example for purposes of illustration, the same or similar substitutions of polymeric binder component 18 for metallic binder component 16 and/or tungsten-containing powder 14 may be used with the compositions presented above.

The size of the individual particles of the components of article 10 may vary. In the context of at least firearms projectiles in which binder 12 includes tin-containing powder 20, a nominal (average) particle size of 150 mesh has proven effective for powder 20. Similarly, tin-containing powder 20 having a nominal size of 80 mesh, with no more than 75% being minus 325 mesh has also proven effective. Suitable tin-containing powder is available from Acupowder, Inc. and sold under the trade name Acu-150™. Similarly, tungsten-containing powder 14 in the form of ferrotungsten powder having a particle size of minus 100 mesh, minus 140 mesh and minus 200 mesh has proven effective, with less than 10–12% being minus 325 mesh being particularly effective. Tungsten-containing powder 14 in the form of WHA powder having a size of minus 40 mesh also has proven effective.

It should be understood that these particle sizes are presented for purposes of illustration and not limitation. Similarly, the acceptable particle sizes may vary depending upon the particular mix and composition of powders used to form composition 11, as well as the particular shape, size and/or application of the article to be formed. For example, when article 10 is formed by filling a die with composition of matter 11, it is desirable for the non-compacted mixture of powders to have sufficient flowability (Hall flow test) to readily fill the dies that give the projectiles their shapes. In some embodiments, it may be desirable for the lower density powder(s) to be finer than the higher density powder(s) to discourage separation of the powders after mixing but prior to compaction.

It should also be understood that article 10 and composition of matter 11 may include components other than tungsten-containing powder 14 and binder 12. For example, the composition containing powder 14 and binder 12 may, but does not necessarily, include a relatively small component, such as between approximately 0 and approximately 1 wt %, of a suitable lubricant 22, such as to facilitate easier removal of the bullet from a die. This is graphically illustrated for purpose of illustration in dashed lines in FIG. 4, but it should be understood that any of the articles 10 discussed, incorporated and/or illustrated herein may include lubricant 22. An example of a suitable lubricant is Acrawax™ dry lubricant, although others may be used. As discussed, article 10 and/or composition of matter 11 may be formed without a lubricant. Similarly, when the article is formed with a binder 12 that includes tin-containing powder 20, the powder may provide sufficient lubrication.

As discussed, article 10 may take a variety of forms, including being used to form articles that conventionally have been produced from lead. However, unlike lead, article 10 is preferably formed from non-toxic (at least in the concentration and composition present in article 10), environmentally safe components. Articles constructed according to the present invention are preferably lead-free, especially in the context of articles that will be used for water-related activities such as bird hunting and fishing. Illustrative examples of articles 10 that may be formed from compositions of matter 11 according to the present invention include a firearms projectile 36, such as a bullet 38 or a shot 40, a radiation shield 42, aircraft stabilizer 43, foundry article 44, lead substitute 45, or weights 46, such as a golf club weight 47, wheel weight 48, diving belt weight 49, counterweight 50, fishing weight 52, ballast weight 54, etc. Examples of these articles are schematically illustrated in FIG. 6. In FIG. 6, two exemplary types of bullets 38 are shown, namely frangible bullets 39 and infrangible bullets 41. Also shown in FIG. 6 are articles 10 in the form of cores 56 for shot or bullets, shot shells 60 and firearms cartridges 80.

A shot 40 according to the present invention is schematically illustrated in FIG. 7. Although illustrated in FIG. 7 as having a spherical configuration, it is within the scope of the invention that shot 40 may have non-spherical configurations as well. In solid lines in FIG. 7, shot 40 is shown being completely formed from a composition of matter 11 constructed according to the present invention. It is also within the scope of the invention that shot 40 may include a component that is formed from a material other than the composition of matter discussed herein. For example, and as indicated in fragmentary dashed lines in FIG. 7, shot 40 may include a core 56 that is at least substantially or completely formed from a composition of matter 11 according to the present invention and further includes a coating 13, such as a jacket 58.

In FIG. 8, an example of a shotgun shell constructed with shot 40 is shown and generally indicated at 60. Shell 60 includes a case or casing 62, which includes a wad 64, a charge 66 and a primer, or priming mixture, 68. In the illustrated embodiment, case or casing 62 encloses a plurality of shot 40. It is within the scope of the invention that shell 60 may include as few as a single projectile, which perhaps more appropriately may be referred to as a shot slug, and as many as dozens or hundreds of individual shots 40. It should be understood that the number of shot 40 in any particular shell will be defined by such factors as the size and geometry of shot 40, the size and shape of shell 60, the available volume to be filled by shot 40, etc. For example, a double ought 00 buckshot shell typically contains nine shots 40 having diameters of approximately 0.3 inches, while shells intended for use in hunting birds, and especially smaller birds, tend to contain many more shots 40.

In FIG. 9, an article 10 in the form of a golf club constructed with golf club weight 47 is shown and generally indicated at 70. Club 70 includes an elongate shaft 72, which typically includes a grip 74, and a head 76 with a face 78 that is adapted to strike a golf ball. The shape and configuration of club 70 may vary, such as from a putter, to an iron, to a driver or other wood.

Figure 10:
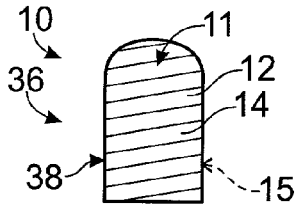
FIG. 10 is a schematic side elevation view of a bullet constructed according to the present invention.

An article 10 in the form of a bullet 38 according to the present invention has been schematically illustrated in FIG. 10. It should be understood that bullet 38 may take any suitable shape and configuration, such as those known in the art for conventional bullets. As also indicated in dashed lines at 15 in FIG. 10, the article may also form a core for a jacketed bullet.

Figure 11:
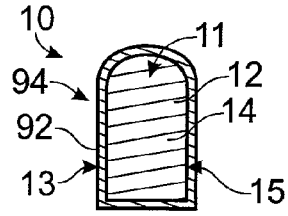
FIG. 11 is a schematic cross-sectional view of a firearms cartridge including the bullet of FIG. 10.

In FIG. 11, an article 10 in the form of a firearms cartridge 80 containing bullet 38 is shown. Cartridge 80 includes bullet 38 and a case or casing 82. Casing 82 includes a cup 84, a charge 86 and a primer, or priming mixture, 88. Casing, primer and charge may be of any suitable materials, as is known in the art of firearms. Cartridge 80 is ready to be loaded into a gun, such as a handgun, rifle or the like, and upon firing, discharges bullet 38 at high speeds and with a high rate of rotation. Although illustrated in FIG. 11 as a centerfire cartridge, in which primer 88 is located in the center of the base of casing 82, bullets according to the present invention may also be incorporated into other types of cartridges, such as a rimfire cartridge, in which the casing is rimmed or flanged and the primer is located inside the rim of the casing.

Figure 12:
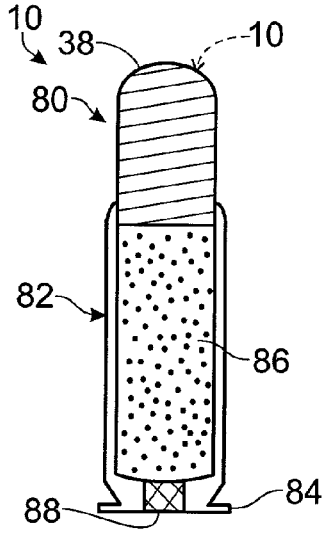
FIG. 12 is a schematic side elevation view of a jacketed bullet according to the present invention.
Figure 13:
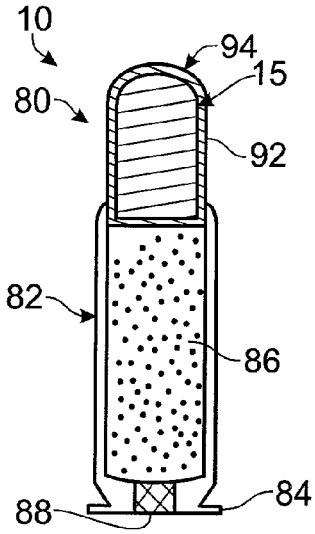
FIG. 13 is a schematic cross-sectional view of a firearms cartridge including the jacketed bullet of FIG. 12.

Bullet 38 may alternatively include a protective coating 13, such as a jacket 92, as shown in FIG. 12. In such an embodiment, bullet 38 may be referred to as a jacketed bullet, as indicated in FIG. 12 at 94, and jacket 92 may be described as at least substantially, if not completely, enclosing a core 15 formed at least substantially from composition of matter 11. In FIG. 13, the jacketed bullet is shown forming a component of a cartridge 80. Because bullets are commonly expelled from firearms at rotational speeds greater than 10,000 rpm, the bullets encounter significant centrifugal forces. When the bullet is formed from powders, there is a tendency for these centrifugal forces to remove portions of the bullet during firing and flight. Jacket 92 may be used to prevent these centrifugal forces from fragmenting, obturing (deforming on account of fragmenting and centrifugal forces), and/or dispersing the core during flight.

Jacket 92 may partially or completely enclose the bullet core. For example, it is within the scope of the invention that jacket 92 may completely enclose the bullet core. Alternatively, the jacket may only partially enclose the core, thereby leaving a portion of the core not covered by the jacket. For example, the tip of the bullet may be unjacketed.

Jacket 92 may have a variety of thicknesses. Typically, jacket 92 will have an average thickness of approximately 0.025 inches or less, including an average thickness of approximately 0.01 inches or less. Accordingly, it should be understood that the depicted thickness of the jacket and relative thickness of the jacket compared to the overall shape and size of the bullet in FIGS. 12 and 13 have been exaggerated for the purpose of illustration.

An example of a suitable material for jacket 92 is copper, although other materials may be used. For example, jacket 92 may be additionally or alternatively formed from one or more other metallic materials, such as alloys of copper like brass, a ferrous metal alloy, or aluminum. Jacket 92 may also be formed from a non-metal material, such as a polymer or a plastic. An example of such a material is nylon. When jacket 92 is formed from metallic materials, the bullet may be formed by compressing the powder and the binder in the jacket. Alternatively, the bullet core may be formed and thereafter placed within a jacket. As another example, the bullet core may be formed and then the jacket may be applied over the core by electroplating, vapor deposition, spray coating or other suitable application methods. For non-metallic jackets, dip coating, spray coating and similar application methods have proved effective.

Some firearms, such as handguns and rifles, have barrels with rifling that projects internally into the barrels to impart axial rotation to the bullet. Accordingly, a jacketed bullet according to the present invention preferably has a jacket thickness that exceeds the height of the rifling. Otherwise, it may be possible for the rifling to cut through the jacket and thereby expose the bullet core. This, in turn, may affect the flight and performance of the bullet, as well as increase fouling of the barrel. A jacket thickness that is at least 0.001 inches, and preferably at least 0.002 to 0.004 inches thicker than the height of the rifling lands have proven effective. For most applications, a jacket 92 that is at least 0.005 inches thick should be sufficient. In firearms, such as shotguns, that have barrels with smooth (non-rifled) internal bores, a thinner jacket may be used, such as a jacket that is 0.001–0.002 inches thick. However, it should be understood that it is not required in these applications for the jacket to be thinner and that thicker jackets may be used as well.

Firearms projectiles 36 constructed according to the present invention may be either ferromagnetic or non-ferromagnetic, as discussed previously. Similarly, projectiles 36 may be frangible or infrangible. For example, in some applications it may be desirable for the projectile to be infrangible to increase the penetrating strength of the projectile. Alternatively, it may be desirable in other applications for the projectile to be frangible to decrease the penetrating strength and potential for ricochet of the projectile. For example, frangible projectiles may be desired when the projectiles will be used for target practice.

By "frangible," it is meant that the projectile is designed to remain intact during flight but to break into pieces upon impact with a relatively hard object. Frangible projectiles may also be referred to as non-ricocheting projectiles. Although it is within the scope of the present invention that projectile 36 is constructed, or designed, to break into several pieces upon impact, it is preferred that projectile 36 is at least substantially reduced to powder upon impact, and even more preferable that the projectile is completely reduced to powder upon impact. By "substantially reduced to powder" it is meant that at least 50% of the projectile (metallic powder 14 and binder 12) is reduced to powder. Preferably, at least 75% of the projectile and even more preferably at least 95% of the projectile is reduced to powder upon impact. Another exemplary construction for a frangible projectile is a projectile in which the resulting particles from the composition of matter forming the bullet (or core) each weigh less than 5 grains (0.324 grams). When the projectile or other article is frangible, it may be coated, painted, or plated to reduce particle loss during handling and machining. For example, a wax, epoxy or metal coating may be used.

Figure 14:
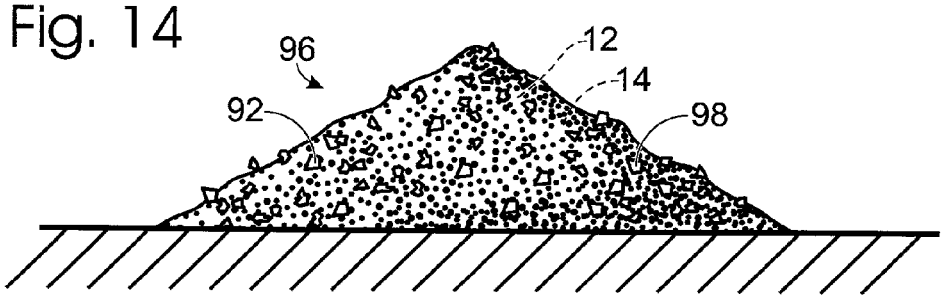
FIG. 14 is a schematic side elevation view of a frangible embodiment of the bullet of FIG. 13 after firing of the cartridge.
Figure 15:
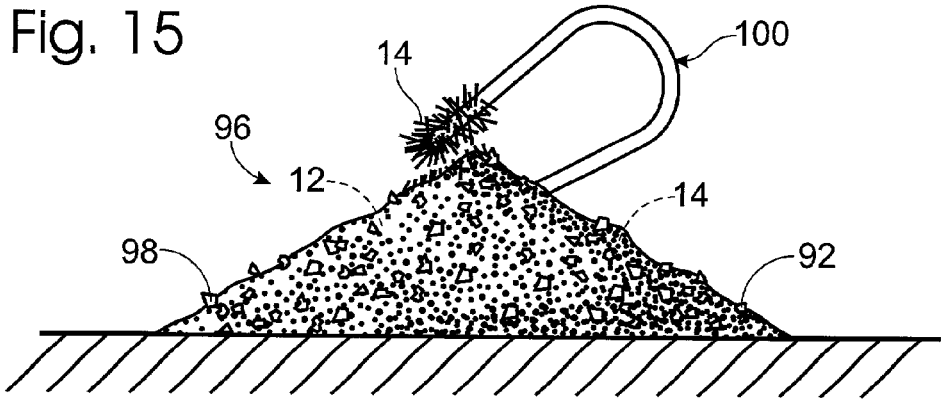
FIG. 15 is a schematic side elevation view showing a method for recovering ferromagnetic portions of the bullet of FIG. 13 after firing of the cartridge.

In FIG. 14, resultant powder 96 produced from a fired frangible jacketed bullet is shown. In FIG. 14, portions of jacket 92 are visible in the resultant powder. In many applications, powder 96 may contain contaminants 98, such as portions of targets, debris and the like that are mixed with the powdered bullet when the powder is accumulated. In embodiments in which tungsten-containing powder 14 is selected to be ferromagnetic, such as by including ferrotungsten, the tungsten-containing powder 14 may be recovered from the resultant powder, portions of jacket 92 and contaminants 98 using a magnet 100, as somewhat schematically illustrated in FIG. 15. Similarly, magnets may be used to recover magnetic projectiles from bodies of water and from shooting ranges. Such a projectile may also be referred to as a recyclable projectile because it is easily reclaimed. Using a ferromagnetic tungsten-containing powder 14 also enables an easy determination, using a magnet, that the projectile is not formed from lead, which is not magnetic.

Although ferromagnetic powders may be desirable in some applications, it is within the scope of the present invention that tungsten-containing powders may be used that are not ferromagnetic or which do not produce a ferromagnetic composition of matter 11 in the concentration in which the powder is present.

As discussed, article 10 is formed of a composition of matter 11 that is at least substantially, if not completely, formed from tungsten-containing powder 14 and binder 12, which are mixed together via any suitable mechanism appropriate for tungsten-containing powder and the particular type or types of binder 12 being used. Illustrative and non-exclusive examples of suitable mechanisms include blenders, such as a V-cone blender, and grinding mills. When binder 12 includes a metallic binder component 16, a high-energy mill or attritor may optionally be used to obtain mechanical alloying effects, such as described in U.S. Pat. No. 6,248,150, the complete disclosure of which is hereby incorporated by reference for all purposes.

Figure 16:
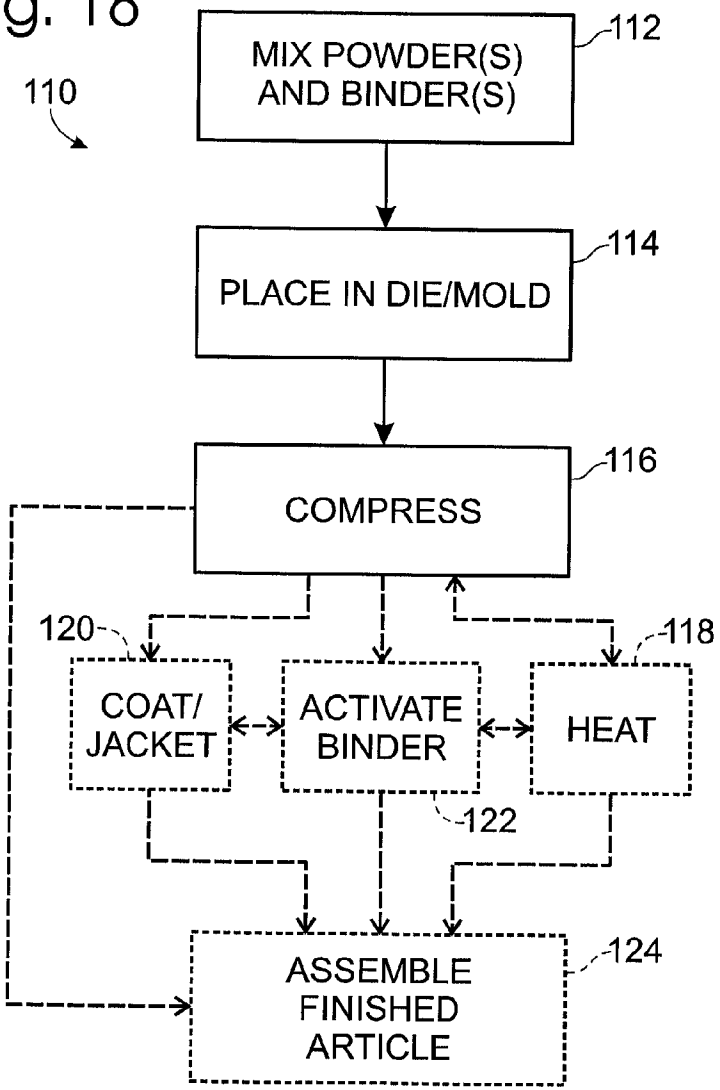
FIG. 16 is a flow chart illustrating methods for preparing the articles according to the present invention.

A flow chart depicting illustrative steps for forming articles 10 according to the present invention is shown at 110 in FIG. 16. At 112 the above-described mixing step is shown. The amount of tungsten-containing powder 14 and binder 12 is selected based in part on one or more of the desired density of the finished article, the force with which the composition will be compacted, and the densities of powder 14 and binder 12, and the intended application and/or processing steps for the article. For example, when tungsten-containing powder 14 contains ferrotungsten powder and WHA powder that has a higher density than the ferrotungsten powder, less of the tungsten-containing powder will be required to obtain the same density as a corresponding article made without WHA powder.

The mixed powders are placed into a die, such as a profile die, or other suitable mold or shape-defining device or devices that defines at least substantially the desired post-compression shape of the composition of matter and which provides a base or frame against which the powder and binder may be compressed. The composition of matter is then compressed, as indicated graphically in FIG. 16 at 114 and 116, respectively. Compressive rams or other suitable pressure-imparting devices or mechanisms are then used to compress the composition of matter. In experiments, 9800 lb force applied using various compaction ram diameters, such as 0.33 inches, has proven effective, at least in the context of smaller articles, such as firearms projectiles and some fishing weights. A rotary press system also has proven effective for use in this step.

It should be understood that the particular amount of force and method of compression may vary. Similarly, it should be understood that the compaction pressure may vary, depending, for example, upon the size, shape and intended use and density of the finished article. At least in the context of firearms projectiles, compaction pressures in the range of approximately 48 to approximately 82 ksi (48,379–82,245 psi) have proven effective, and in some embodiments compaction pressures of greater than 40 ksi, greater than 60 ksi, greater than 80 ksi and even greater than 100 ksi have proven effective. Another method for forming article 10 from powder 14 and binder 12 is through injection molding, in which the powders are mixed with a lubricant, extruded and then sintered.

It should be understood, however, that the above-presented pressure ranges are presented for purposes of illustration and that pressures outside of these ranges may be used and are within the scope of the present invention. Generally speaking, increasing the compaction pressure reduces the voids or free-space within the article, thereby increasing the density of the article. By way of background, all mixtures of powdered components have a theoretical density that can be calculated based on the compositions and weight percentages of the powders. Typically, an article produced by compacting these powders will not achieve this theoretical density because of voids or free-spaces with the article. As the mixture of powders is compacted at higher pressures, the amount of void space is reduced, or even eliminated.

The composition of matter may be cold compacted, namely, compacted without heating. Additionally or alternatively, the composition of matter may be heated, including heating to the point of annealing and/or sintering, as shown in FIG. 16 at 118. Although graphically illustrated as occurring after compression step 116 in FIG. 16, it is within the scope of the invention that any one or more of the above-described types of heating of the composition of matter and/or article may occur at one or more stages within the formation process, including before, during and/or after the compression step. It also should be understood that heating is not required and that articles 10 may be produced according to the present invention without requiring the composition of matter to be heated. Typically, frangible articles are not sintered, but they may or may not be heated or annealed. Sintering may be either solid-phase sintering, in which the article is heated to near the melting point of the lowest melting component, or liquid-phase sintering, in which the article is heated to or above the melting point of the lowest melting component.

In some embodiments, after compression step 116 and/or heating step 118, article 10 is suitably formed. In some embodiments, the compacted composition of matter forms a core 15 that is thereafter coated or jacketed, as indicated 120. For example, and as discussed previously, some bullets and other firearms projectiles are jacketed and it may be desirable to coat a compacted article according to the present invention to protect the article during handling, processing and/or assembly into a finished article.

As indicated at 122, some binders 12, such as many polymeric binders 18, require actuation to achieve the desired cross-linking, curing, setting or adhesion. The particular method of actuating the binder will tend to vary depending upon such factors as the particular binder or binders being used. For example, some binders are actuated by heating. Others are actuated by hydration, and still others are actuated by compression. It should be understood that the actuating step may, in some embodiments, occur during the compression step, such as when heat or pressure are used to actuate the binder.

Examples of heat-actuated binders include thermoplastic resins and thermoset resins, including the above-described rebar epoxies. It has been found that heating articles, and especially smaller articles such as bullets, shot, golf club weights and some fishing weights, at a temperature in the range of approximately 150° F. and approximately 445° F. for a time period in the range of 30 seconds and several hours is effective. Some compositions of matter 11 according to the present invention may have a greater tendency to crack as they are exposed to higher temperatures for longer periods of time, and therefore it should be understood that the temperature and time period may vary depending upon the particular composition being used. Other illustrative temperature ranges for heating of article 10 include heating at a temperature less than approximately 250° F., less than approximately 200° F., and in the range of approximately 150° F. and approximately 175° F. Similarly, heating for less than approximately 15 minutes has proven effective, with heating for less than approximately 5 minutes being suitable for many applications.

Because the particular composition of article 10 will vary depending on the particular powders and binders being used, and relative concentrations thereof, it should be understood that temperatures outside of this range may be effective for a particular article. For example, articles 10 in the form of bullets using melamine as polymeric binder 18 have been effectively cured at temperatures in the range of 340° F. and 410° F. for several minutes without cracking. It should also be noted that curing rebar epoxies at 150–175° F. for approximately 5 minutes has proven effective when these epoxies are used as the polymeric binder 18, despite the fact that these epoxies are normally cured at much higher temperatures when used as rebar epoxies.

Examples of water-actuated binders include Portland cement, vinyl cement and urea formaldehyde. Typically, the actuation step includes immersion of the articles in water, followed by a drying period. In experiments, the articles were immersed in water from between a few seconds and almost an entire day. For most water-actuated binders, an immersion, or water-contacting, period of less than an hour, and preferably less than a minute and even more preferably approximately 5–10 seconds was sufficient.

As discussed, article 10 may include a coated or uncoated core that forms a component or portion of a finished article, which also includes other structures or components. When such an article is to be formed, the finished article is typically (but not necessarily in all embodiments) assembled after the compression step and/or after the coating, actuation or heating steps, as indicated in FIG. 16 at 124. For example, bullets or shot may be incorporated into firearms cartridges or shells, golf club weights may be incorporated into golf clubs, etc.

Figure 17:
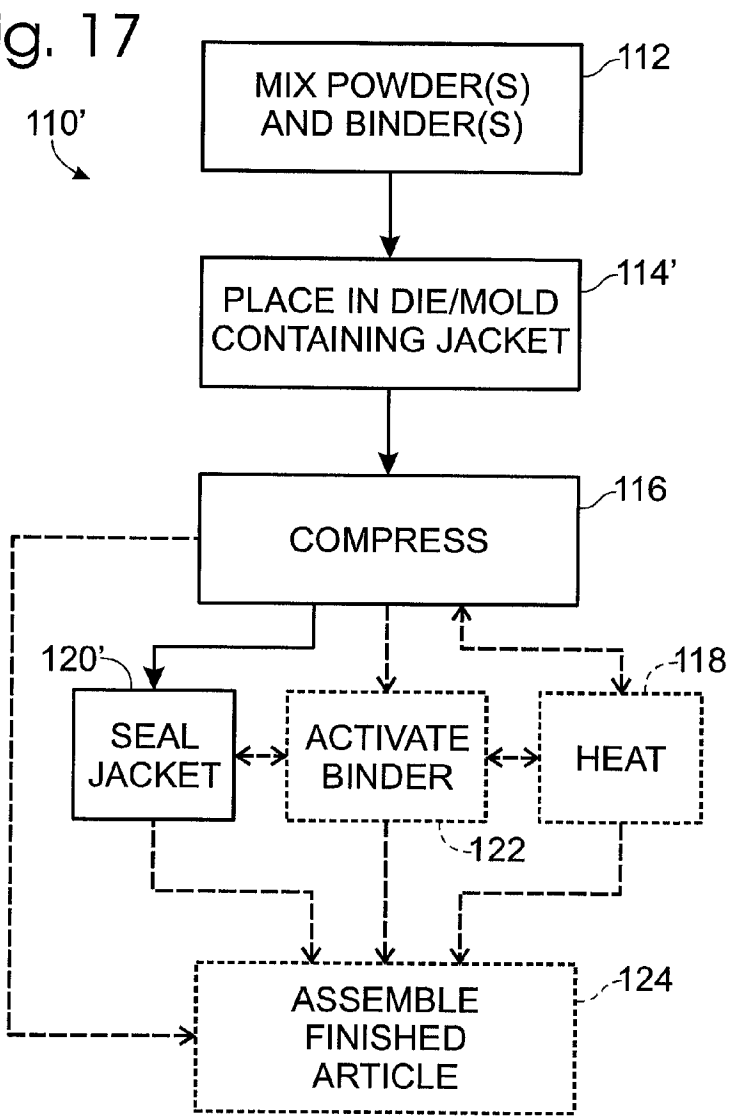
FIG. 17 is a flow chart illustrating additional methods for preparing jacketed articles according to the present invention.

When a jacketed article 10 is to be formed, it is possible to place the mixed powder 14 and binder 12 into the jacket (such as jackets 58 or 92) prior to compressing the composition of matter. For example, powder 14 and binder 12 may be mixed and then added to the jacket, which may subsequently be placed into a die. Alternatively, the jacket may be placed into a die or other suitable mold, and then the mixed powder and binder are added thereto. Examples of these methods are shown in FIG. 17 at 110'. It should be understood that step 114' may include either of the combinations discussed above, or any other suitable method of placing the composition of matter into a jacket and placing the jacket into a die or other suitable mold. In FIG. 17, it can also be seen that step 120 from FIG. 16 is now step 120'. More specifically, because the method depicted in FIG. 17 includes partially jacketing the composition of matter prior to compression, the jacket only needs to be sealed after compression and/or actuation.

Figure 18:
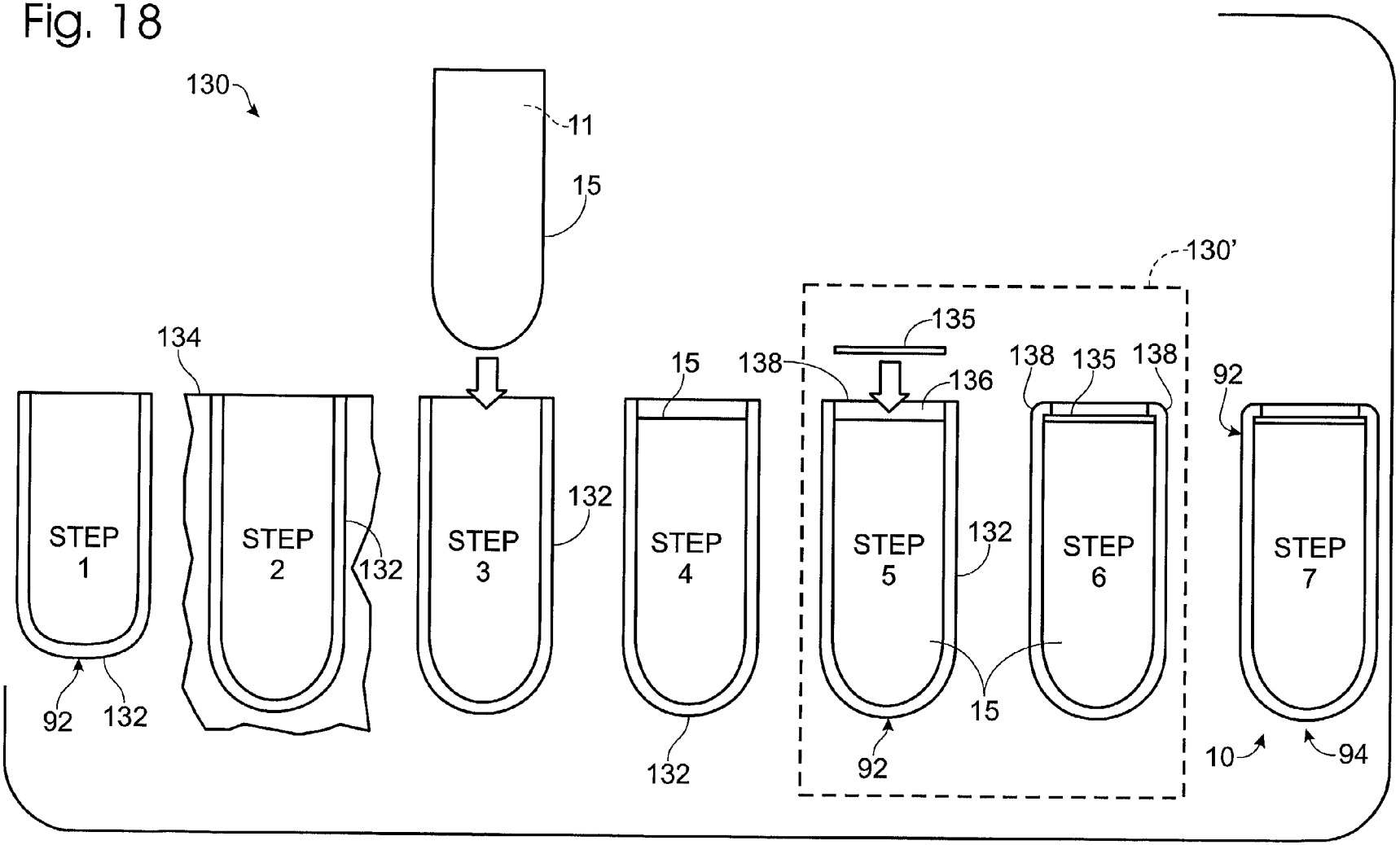
FIG. 18 is a diagram illustrating a method for forming the jacketed bullet of FIGS. 12 and 13.

In FIG. 18, an example of a suitable method for forming an article 10 in the form of a jacketed bullet 94 is shown and generally indicated at 130. In the illustrated example, jacket 92 starts as a body 132 of a pinch-trimmed jacket that is placed into die 134 and subsequently shaped to a point-form jacket. A core 15 formed at least substantially from composition of matter 11 is inserted into body 132. Alternatively, an uncompacted composition of matter 11 is added to the jacket, and then subsequently compressed, and in some embodiments heated and/or actuated. The jacket is then sealed through any suitable mechanism, such as discussed below.

Also shown in FIG. 18 is an illustrated method for sealing a jacket, such as discussed previously with respect to step 120' in FIG. 17. As shown, a retainer disk 135 is placed over the opening 136 of jacket body 132, and then the ends 138 of the point-formed jacket are crimped around the disk to enclose core 15. It should be understood that FIG. 18 is provided as an illustration of one suitable method, but other suitable methods may be used as well and are within the scope of the present invention.

Prior to placing the composition of matter into a die or other mold, the die or mold may be lubricated to facilitate easier removal of the compacted article. Any suitable die lubricant may be used. As discussed, it is also within the scope of the invention that a lubricant may be mixed with the powders prior to compaction. Examples of suitable lubricants are Acrawax™ dry lubricant and stearic acid, but others may be used. Generally, the addition of a lubricant to the powders decreases the density of the compacted article. Typically, but not exclusively, non-metal lubricants are only present in less than 2 wt %, and often less than 0.5 wt % (such as 0.2–0.3 wt %).

However, and as discussed above, it is within the scope of the present invention that article 10 may optionally be formed without the addition of a lubricant to the composition of matter and/or without lubricating the dies. More specifically, tin-containing powder 20 not only binds the tungsten-containing powder together, but also provides sufficient lubrication. In other words, article 10 may be produced entirely from metal powders, without requiring the addition of wax, polymers or other lubricants or non-metallic binders. Typically, tin-containing powder 20 is present in at least 10 wt % to obviate the need for a lubricant. It is also within the scope of the invention that other relatively soft metals, such as copper, may be used as a metallic lubricant and binder.

Industrial Applicability

The present invention is applicable to any powder metallurgy application in which powders containing tungsten and at least one binder are used to form articles, such as firearms projectiles, radiation shields, weights, and other lead substitutes.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

I claim:

1. A firearms cartridge, comprising:

a casing;

a primer;

a propellant; and at least one projectile having a density of at least 10 g/cc, wherein the projectile is formed by compressing a powder-form composition of matter that includes a tungsten-containing powder and a binder that includes a metallic binder component and a non-metallic binder component, wherein the metallic binder component includes at least 50 wt % tin, and further wherein the non-metallic binder component includes at least one of a thermoset resin or epoxy and comprises 0.25 to 3 wt % of the powder-form composition of matter.

2. The cartridge of claim 1, wherein the at least one projectile has a density of at least 10.5 g/cc.

3. The cartridge of claim 2, wherein the at least one projectile has a density of at least 12 g/cc.

4. The cartridge of claim 1, wherein the projectile further includes a coating.

5. The cartridge of claim 4, wherein the projectile further includes a jacket.

6. The cartridge of claim 1, wherein the cartridge is a shot shell.

7. The cartridge of claim 6, wherein the cartridge includes a plurality of projectiles in the form of shot.

8. The cartridge of claim 1, wherein the cartridge is adapted to be fired from a firearm having a barrel with rifling, and further wherein the at least one projectile is a single projectile in the form of a bullet.

9. The cartridge of claim 8, wherein the bullet is jacketed.

10. The cartridge of claim 8, wherein the bullet is frangible.

11. The cartridge of claim 8, wherein the bullet is infrangible.

12. The cartridge of claim 8, wherein the bullet is ferromagnetic.

13. The cartridge of claim 8, wherein the bullet is not ferromagnetic.

14. The cartridge of claim 1, wherein the tungsten containing powder has a density of at least 15 g/cc.

15. The cartridge of claim 1, wherein the tungsten-containing powder includes ferrotungsten powder.

16. The cartridge of claim 1, wherein the tungsten-containing powder includes a tungsten alloy powder.

17. The cartridge of claim 1, wherein the metallic binder component includes at least 70 wt % tin.

18. The cartridge of claim 1, wherein the metallic binder component constitutes less than 30 wt % of the at least one projectile.

19. The cartridge of claim 18, wherein the metallic binder component constitutes less than approximately 25 wt % of the at least one projectile.

20. The cartridge of claim 1, wherein the non-metallic binder component includes an epoxy.

21. The cartridge of claim 20, wherein the non-metallic binder component includes a flexible epoxy.

22. The cartridge of claim 20, wherein the non-metallic binder component includes a rigid epoxy.

23. The cartridge of claim 20, wherein the non-metallic binder component includes a flexible epoxy and a rigid epoxy.

24. The cartridge of claim 20, wherein the non-metallic binder component includes a first one of a thermoset resin or epoxy, with the first one having a first composition and at least a second one of a thermoset resin or epoxy, with the second one having a composition different than the first composition.

25. The cartridge of claim 24, wherein the at least one projectile includes at least one shot.

26. The cartridge of claim 24, wherein the at least one projectile includes a bullet.

27. The cartridge of claim 1, wherein the non-metallic binder component comprises less than 1 wt % of the projectile.

28. The cartridge of claim 1, wherein the projectile further includes a lubricant.

29. Thecartridge of claim 1, wherein the composition of matter is not sintered.

30. Thecartridge of claim 1, wherein the composition of matter is sintered.

31. A method for manufacturing a medium-density article, the method comprising:

mixing a tungsten-containing powder with a binder powder to form a powder-form composition of matter, wherein the binder powder includes a metallic binder component and a non-metallic binder component, and further wherein the metallic binder component forms at least 10 wt % of the powder-form composition of matter and the non-metallic binder component forms 0.25 to 3 wt % of the powder-form composition of matter and includes at least one of a thermoset resin or epoxy;

placing the powder-form composition of matter into a die; and compressing the powder-form composition of matter to produce an article having a density of at least 8 g/cc.

32. The method of claim 31, further comprising the step of actuating the non-metallic binder component.

33. The method of claim 32, wherein the non-metallic component is a heat-actuated component.

34. The method of claim 32, wherein the non-metallic component is a water-actuated component.

35. The method of claim 32 wherein the non-metallic component is a pressure-actuated component.

36. The method of claim 31, wherein the metallic binder component includes a tin-containing powder.

37. The method of claim 31, wherein the tungsten-containing powder has a bulk density less than the density of pure tungsten.

38. The method of claim 31, wherein the compressing step includes compressing the composition of matter to at least 60 ksi.

39. The method of claim 38, wherein the compressing step includes compressing the composition of matter to at least 75 ksi.

40. The method of claim 31, wherein the method includes coating the composition of matter after the compressing step.

41. The method of claim 31, wherein the article is a firearms projectile.

42. The method of claim 31, wherein the article is a golf club weight.

43. The method of claim 31, wherein the article is a radiation shield.

44. The method of claim 31, wherein the composition of matter is ferromagnetic.

45. The method of claim 31, further including heating the composition of matter without sintering the composition of matter.

46. The method of claim 45, wherein the metallic binder component comprises at least 70 wt % tin and wherein the method further includes heating the composition of matter to a temperature that is less than the melting point of the metallic binder component.

47. The method of claim 31, wherein the article has a density of at least 10.5 g/cc.

48. The method of claim 47, wherein the article has a density of at least 12 g/cc.

49. The method of claim 31, wherein the powder-form composition of matter further includes a lubricant.

50. The method of claim 31, wherein the metallic binder component consists essentially of tin.

51. The method of claim 50, wherein the method includes heating the powder-form composition of matter to a temperature greater than 150° F. and less than the melting point of tin.

52. The method of claim 31, wherein the non-metallic binder component includes a flexible heat-curable epoxy.

53. The method of claim 31, wherein the non-metallic binder component forms 0.25 to 1 wt % of the powder-form composition of matter.

54. An unsintered, frangible firearms projectile, comprising:

at least 60 wt % of a tungsten-containing component that consists essentially of at least one of tungsten, a tungsten-containing compound, a tungsten-containing alloy, and mixtures thereof;

less than approximately 30 wt % of a binder, wherein the binder comprises at least 70 wt % tin, wherein the binder further comprises a flexible heat-curable epoxy that forms at least 0.25 wt % of the projectile; and wherein the projectile has a density of at least 10 g/cc.

55. The projectile of claim 54, further comprising a jacket that at least substantially encloses the projectile.

56. The projectile of claim 55, further comprising a casing, a primer, and a propellant to form a firearms cartridge containing the projectile.

57. The projectile of claim 56, wherein the projectile is a shot pellet and the cartridge is a shot cartridge.

58. The projectile of claim 56, wherein the projectile is a bullet.

59. The projectile of claim 58, wherein the bullet is a jacketed bullet.

60. The projectile of claim 54, wherein the projectile further includes a lubricant mixed with the tungsten-containing component and the binder.

* * * * *

UNITED STATES PATENT AND TRADEMARK OFFICE

CERTIFICATE OF CORRECTION

PATENT NO. : 7,217,389 B2
APPLICATION NO. : 10/041873
DATED : May 15, 2007
INVENTOR(S) : Darryl D. Amick It is certified that error appears in the above-identified patent and that said Letters Patent is hereby corrected as shown below:

Column 17,
Line 13, Delete “Thecartridge” and please insert -- The cartridge -- therefor.

Column 17,
Line 15, Delete “Thecartridge” and please insert -- The cartridge -- therefor.

Signed and Sealed this

Eighteenth Day of September, 2007

JON W. DUDAS
*Director of the United States Patent and Trademark Office*